US011106157B1

(12) United States Patent
Shinozaki

(10) Patent No.: US 11,106,157 B1
(45) Date of Patent: Aug. 31, 2021

(54) DEVELOPER SUPPLY DEVICE AND IMAGE FORMING APPARATUS

(71) Applicant: FUJIFILM Business Innovation Corp., Tokyo (JP)

(72) Inventor: Seigo Shinozaki, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 16/922,040

(22) Filed: Jul. 7, 2020

(30) Foreign Application Priority Data

Mar. 25, 2020 (JP) ..... JP2020-054231

(51) Int. Cl.
*G03G 15/08* (2006.01)

(52) U.S. Cl.
CPC ..... *G03G 15/0867* (2013.01); *G03G 15/0889* (2013.01); *G03G 2215/066* (2013.01)

(58) Field of Classification Search
CPC ..... G03G 15/0867; G03G 15/0889; G03G 2215/066
See application file for complete search history.

(56) References Cited

U.S. PATENT DOCUMENTS

| | | | | |
|---|---|---|---|---|
| 8,145,101 | B2 * | 3/2012 | Terai | G03G 15/0844 399/257 |
| 8,559,854 | B2 * | 10/2013 | Sasaki | G03G 15/0896 399/254 |
| 9,335,660 | B2 | 5/2016 | Yoshii | |
| 9,372,440 | B2 | 6/2016 | Furuta et al. | |
| 2007/0286616 | A1 * | 12/2007 | Kojima | G03G 15/0855 399/27 |
| 2008/0317508 | A1 * | 12/2008 | Terai | G03G 15/0844 399/254 |

FOREIGN PATENT DOCUMENTS

| | | | |
|---|---|---|---|
| JP | 2014-240923 | A | 12/2014 |
| JP | 2015-001605 | A | 1/2015 |
| JP | 2015-108843 | A | 6/2015 |

* cited by examiner

*Primary Examiner* — Susan S Lee
(74) *Attorney, Agent, or Firm* — Sughrue Mion, PLLC

(57) ABSTRACT

A developer supply device includes: a toner storage part that can be attached to/removed from a body of the developer supply device and stores toner therein; a toner supply part that receives the toner from the toner storage part and supplies the toner to a developing device that develops an electrostatic latent image formed on an image carrier with developer containing the toner and carrier; a carrier storage part that can be attached to/removed from the body and stores the carrier therein; and a carrier supply part that receives the carrier from the carrier storage part and supplies the carrier to the developing device, the carrier supply part having a smaller capacity than the toner supply part.

12 Claims, 7 Drawing Sheets

DEVELOPER SUPPLY DEVICE AND IMAGE FORMING APPARATUS

CROSS-REFERENCE TO RELATED APPLICATIONS

This application is based on and claims priority under 35 USC 119 from Japanese Patent Application No. 2020-054231 filed Mar. 25, 2020.

BACKGROUND

(i) Technical Field

The present disclosure relates to a developer supply device and an image forming apparatus.

(ii) Related Art

Japanese Unexamined Patent Application Publication No. 2015-108843 discloses a developer container that includes a container body having a toner storage space and a carrier tank having a carrier storage space and that supplies toner and carrier to a developing device.

SUMMARY

Aspects of non-limiting embodiments of the present disclosure relate to reducing the total capacity of a carrier supply part for supplying carrier to a developing device and a toner supply part for supplying toner to the developing device, compared with a case where the carrier supply part and the toner supply part have the same capacity.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a developer supply device including: a toner storage part that can be attached to/removed from a body of the developer supply device and stores toner therein; a toner supply part that receives the toner from the toner storage part and supplies the toner to a developing device that develops an electrostatic latent image formed on an image carrier with developer containing the toner and carrier; a carrier storage part that can be attached to/removed from the body and stores the carrier therein; and a carrier supply part that receives the carrier from the carrier storage part and supplies the carrier to the developing device, the carrier supply part having a smaller capacity than the toner supply part.

BRIEF DESCRIPTION OF THE DRAWINGS

Exemplary embodiment of the present disclosure will be described in detail based on the following figures, wherein.

DETAILED DESCRIPTION

An exemplary embodiment of the present disclosure will be described below with reference to the attached drawings.

Overall Configuration of Image Forming Apparatus

Figure 1:
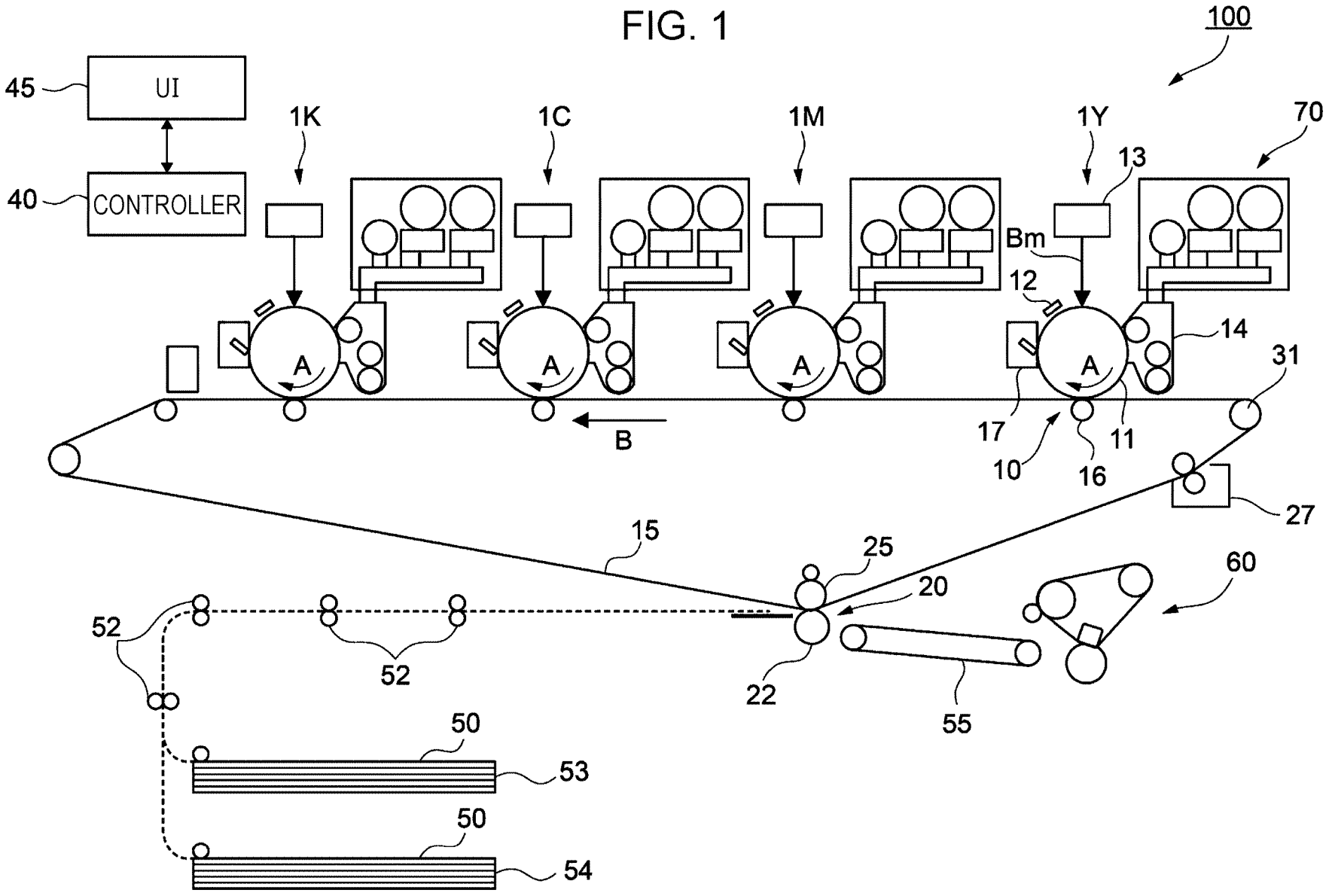
FIG. 1 schematically shows the structure of an image forming apparatus according to an exemplary embodiment.

FIG. 1 schematically shows the structure of an image forming apparatus 100 according to an exemplary embodiment.

The image forming apparatus 100 in FIG. 1 is a so-called tandem image forming apparatus using an intermediate transfer method. The image forming apparatus 100 includes a plurality of image forming units 1Y, 1M, 1C, and 1K that form color-component toner images using an electrophotographic system.

The image forming apparatus 100 includes: first transfer parts 10 that successively first-transfer the color component toner images formed by the image forming units 1Y, 1M, 1C, and 1K to an intermediate transfer belt 15 in a superimposed manner; and a second transfer part 20 that second-transfers the superimposed toner image on the intermediate transfer belt 15 to a sheet 50.

The image forming apparatus 100 also includes: a fixing device 60 that fixes the second-transferred toner image to the sheet 50; a controller 40 that includes a program-controlled central processing unit (CPU) and controls the respective components of the image forming apparatus 100; and a user interface (UI) 45 that includes a display panel and the like and via which information is received from/displayed to a user.

The image forming apparatus 100 also includes developer supply devices 70Y, 70M, 70C, and 70K for supplying developer to developing devices 14 (described below) of the image forming units 1Y, 1M, 1C, and 1K. Although detailed descriptions will be given below, the developer supply devices 70Y, 70M, 70C, and 70K supply, to the developing devices 14 of the image forming units 1Y, 1M, 1C, and 1K, carrier having magnetic properties and color toners corresponding to the image forming units 1Y, 1M, 1C, and 1K, the carrier and the toner serving as developer. In this example, the carrier has a positive charging polarity, and the toner has a negative charging polarity.

The developer supply devices 70Y, 70M, 70C, and 70K have the same structure except for the colors of the toner. Hereinbelow, the developer supply devices 70Y, 70M, 70C, and 70K will be simply referred to as the "developer supply devices 70" when they do not need to be distinguished from one another.

The image forming units 1Y, 1M, 1C, and 1K, serving as a part of an image forming section, each include the following electrophotographic devices: a charger 12 provided near a photoconductor drum 11, which serves as an example of an image carrier and is rotated in an arrow A direction, to charge the photoconductor drum 11; and a laser exposure device 13 that forms an electrostatic latent image on the photoconductor drum 11. The exposure beam emitted from the laser exposure device 13 is denoted by reference sign Bm in FIG. 1.

The image forming units 1Y, 1M, 1C, and 1K also each include: a developing device 14 that stores the developer containing the carrier and the toner and develops the electrostatic latent image on the photoconductor drum 11 with the toner into a visible image; a first transfer roller 16 that transfers the color toner image on the photoconductor drum 11 to the intermediate transfer belt 15 at a first transfer part 10; and a drum cleaner 17 that removes residual toner on the photoconductor drum 11.

The intermediate transfer belt 15 is moved in a cycle at a predetermined speed in the direction of arrow B in FIG. 1 by a driving roller 31 driven by a motor (not shown). The first transfer part 10 includes the first transfer roller 16 opposed to the photoconductor drum 11 with the intermediate transfer belt 15 therebetween. The toner images on the photoconductor drums 11 are successively and electrostatically attracted to the intermediate transfer belt 15, and thus, a superimposed toner image is formed on the intermediate transfer belt 15.

The second transfer part 20 includes a second transfer roller 22, which is disposed on the toner-image carrying side of the intermediate transfer belt 15, and a backup roller 25. The second transfer roller 22 is disposed so as to push the backup roller 25 with the intermediate transfer belt 15 therebetween. The second transfer roller 22 is grounded so that a second transfer bias is formed between the backup roller 25 and the second transfer roller 22, and the toner image is second-transferred to the sheet 50 transported to the second transfer part 20. A belt cleaner 27 removes residual toner on the intermediate transfer belt 15.

The image forming units 1Y, 1M, 1C, and 1K can be attached to/removed from the body of the image forming apparatus 100 in the front-rear direction of the image forming apparatus 100. More specifically, the image forming units 1Y, 1M, 1C, and 1K are removed from the image forming apparatus 100 by being pulled toward the front side of the image forming apparatus 100.

The basic image forming processing of the image forming apparatus 100 will be described.

In the image forming apparatus 100, image data is outputted from an image reading device or the like (not shown), is converted into color-material gradation data of four colors, namely, Y, M, C, and K, through image processing by an image processing device (not shown), and is output to the laser exposure devices 13.

The laser exposure devices 13 irradiate the photoconductor drums 11 of the image forming units 1Y, 1M, 1C, and 1K with exposure beams Bm emitted from, for example, semiconductor laser sources according to inputted color-material gradation data. The surfaces of the photoconductor drums 11 charged by the chargers 12 are irradiated with the exposure light by the laser exposure devices 13, and as a result, electrostatic latent images are formed. After the toner images are formed on the photoconductor drums 11 by the developing devices 14, the toner images are transferred to the intermediate transfer belt 15 at the first transfer parts 10, where the photoconductor drums 11 and the intermediate transfer belt 15 are in contact with each other.

After the toner images are first-transferred to the surface of the intermediate transfer belt 15 in a superimposed manner, the toner image is transported to the second transfer part 20 by the intermediate transfer belt 15. At the second transfer part 20, the second transfer roller 22 is pressed against the backup roller 25 with the intermediate transfer belt 15 therebetween. At this time, a sheet 50 transported from a first sheet storage part 53 or a second sheet storage part 54 by transport rollers 52 and the like is nipped between the intermediate transfer belt 15 and the second transfer roller 22.

The unfixed toner image on the intermediate transfer belt 15 is electrostatically transferred to the sheet 50 at the second transfer part 20. Then, the sheet 50 to which the toner image has been electrostatically transferred is separated from the intermediate transfer belt 15 and is transported to a transport belt 55 provided downstream of the second transfer roller 22 in the sheet transport direction. The transport belt 55 transports the sheet 50 to the fixing device 60.

The toner image on the sheet 50 transported to the fixing device 60 is subjected to heat and pressure by the fixing device 60 and is fixed to the sheet 50. Then, the sheet 50 with the image fixed thereon is discharged from the image forming apparatus 100.

The toner remaining on the photoconductor drums 11 after the first transfer is removed by the drum cleaners 17, and the toner remaining on the intermediate transfer belt 15 after the second transfer is removed by the belt cleaner 27.

The image forming apparatus 100 repeats this image forming processing by the number of cycles corresponding to the number of sheets to be printed.

Configuration of Developer Supply Device

Next, the developer supply device 70 according to this exemplary embodiment will be described.

Figure 2:
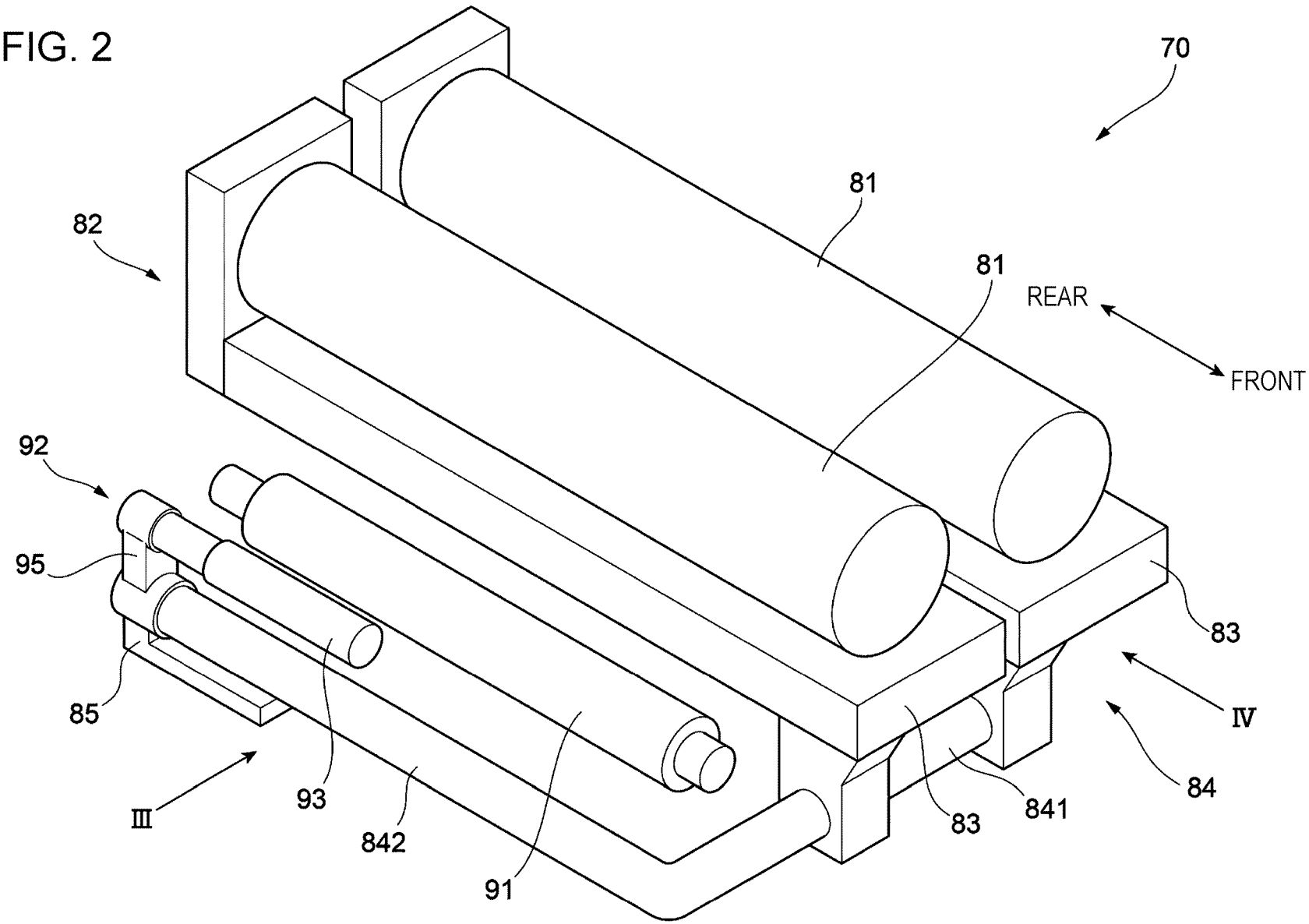
FIG. 2 is a perspective view of a developer supply device according to the exemplary embodiment.

FIG. 2 is a perspective view of the developer supply device 70 according to this exemplary embodiment. The developer supply device 70 is attached to the image forming apparatus 100 (see FIG. 1) such that the lower right part thereof in FIG. 2 is located on the front side of the image forming apparatus 100 and the upper left part thereof in FIG. 2 is located on the rear side of the image forming apparatus 100.

Figure 3:
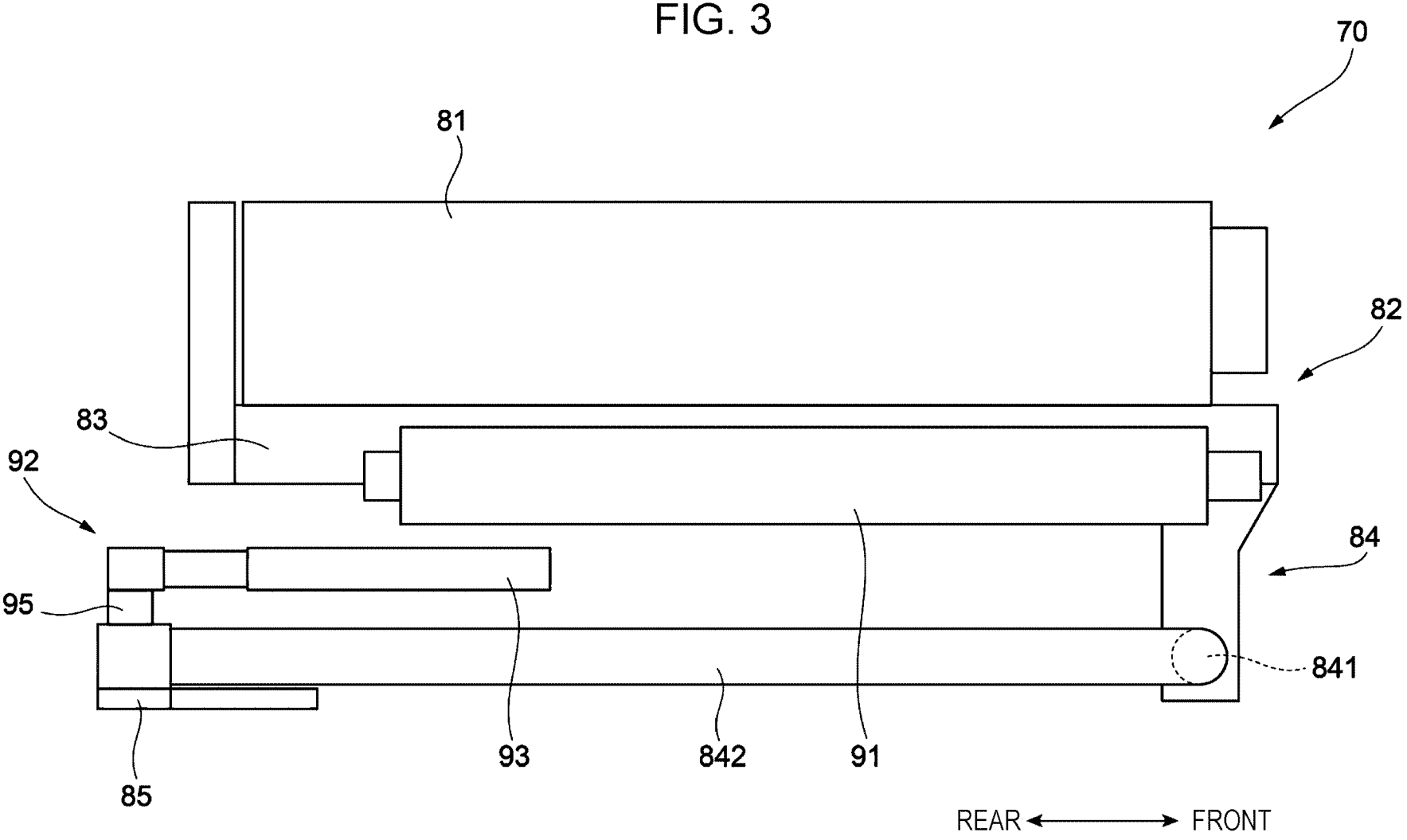
FIG. 3 shows the developer supply device as viewed in direction III in FIG. 2.
Figure 4:
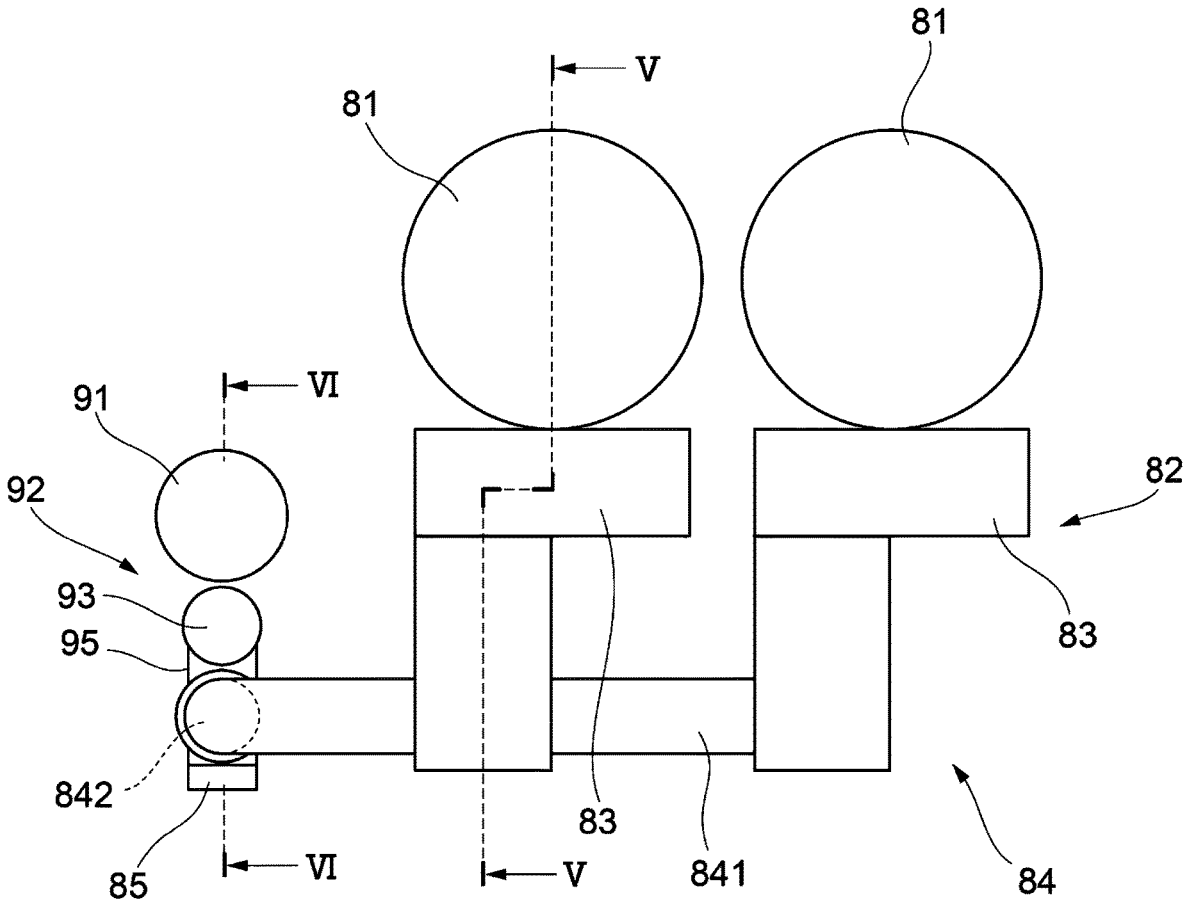
FIG. 4 shows the developer supply device as viewed in direction IV in FIG. 2.
Figure 5:
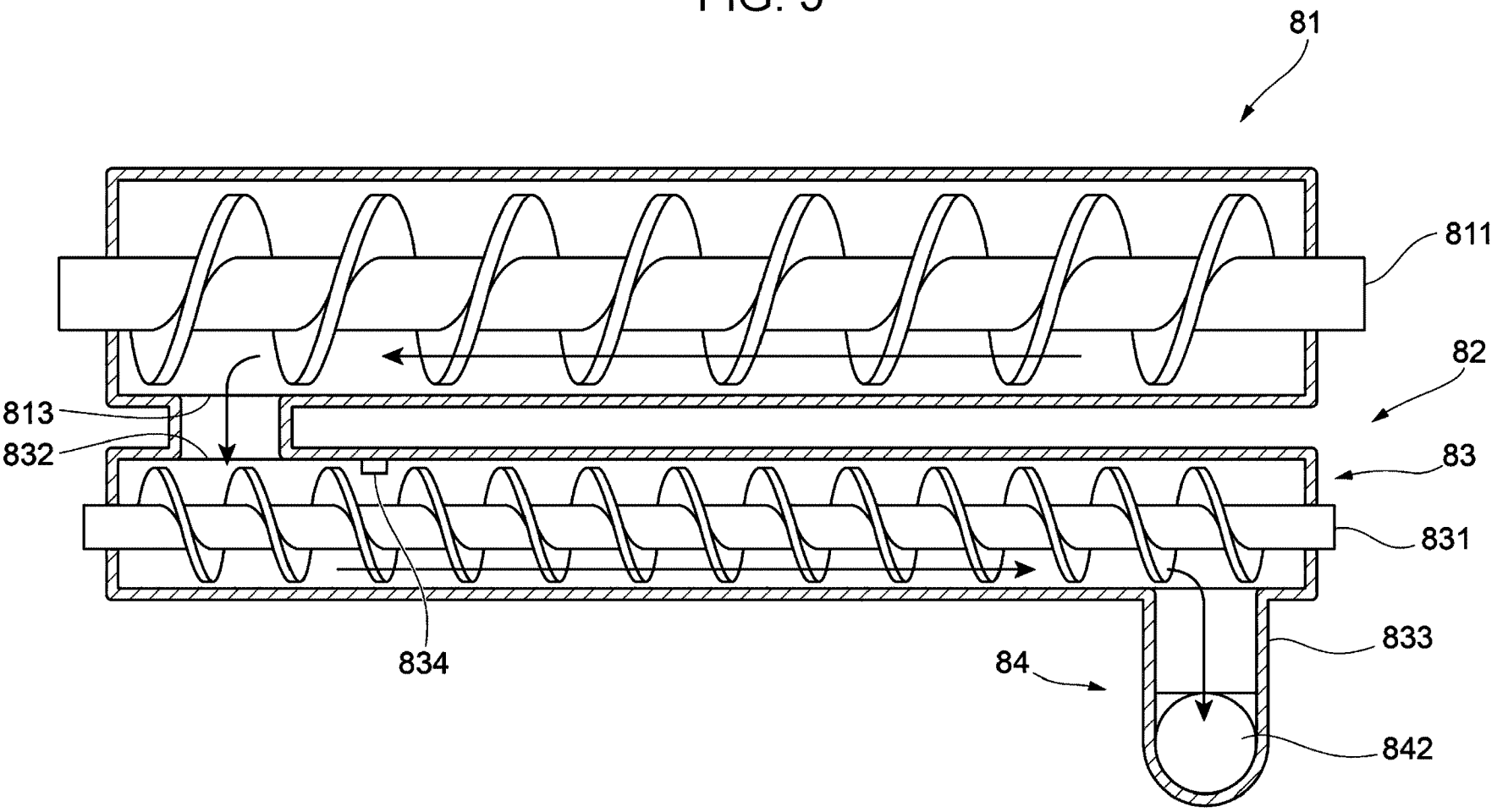
FIG. 5 is a sectional view taken along line V-V in FIG. 4.
Figure 6:
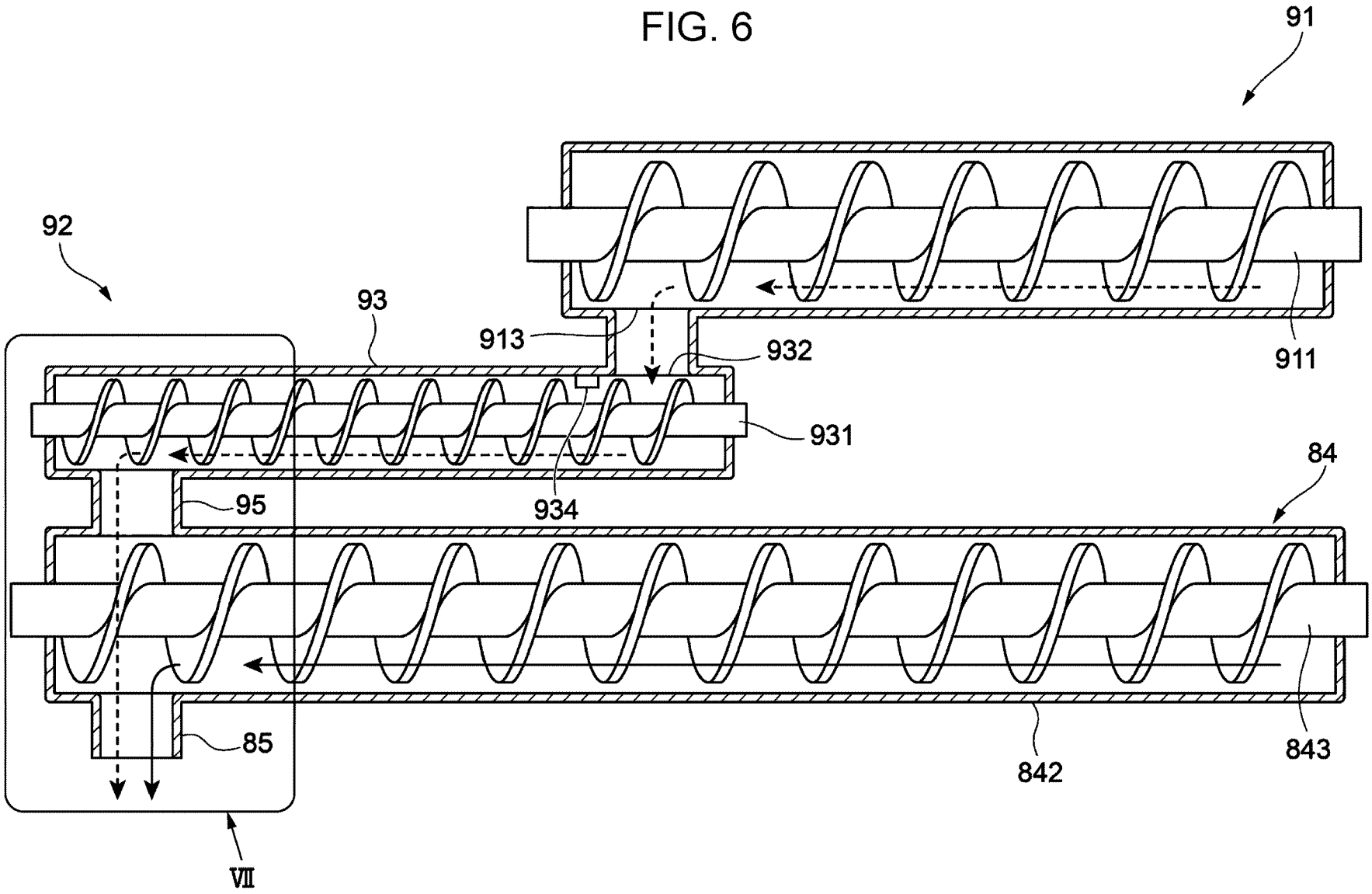
FIG. 6 is a sectional view taken along line VI-VI in FIG. 4.
Figure 7:
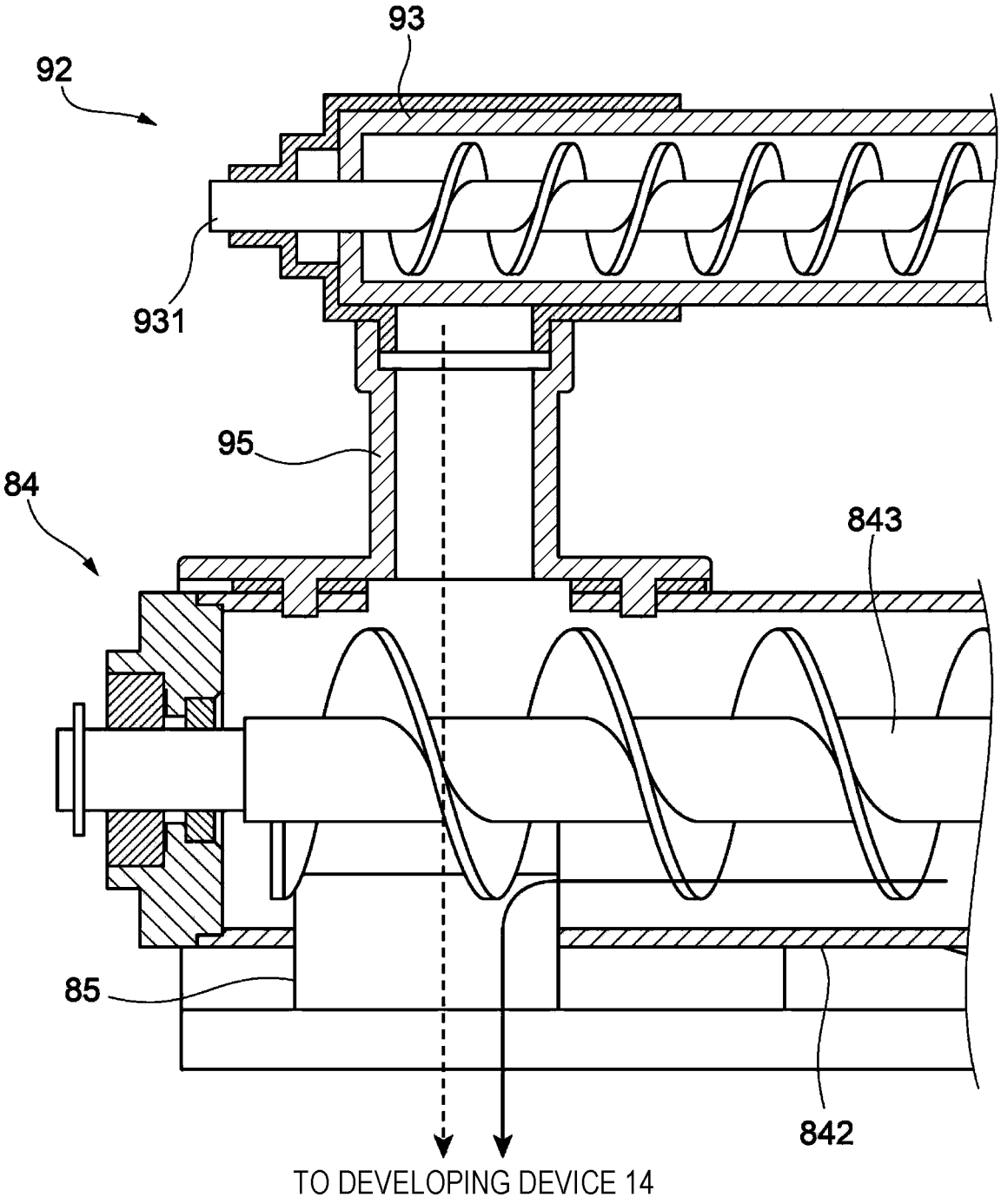
FIG. 7 is an enlarged view of area VII in FIG. 6.

FIG. 3 shows the developer supply device 70 as viewed in direction III in FIG. 2, and FIG. 4 shows the developer supply device 70 as viewed in direction IV (i.e., from the front side) in FIG. 2. FIG. 5 is a sectional view taken along line V-V in FIG. 4, FIG. 6 is a sectional view taken along line VI-VI in FIG. 4, and FIG. 7 is an enlarged view of area VII in FIG. 6.

The developer supply device 70 according to this exemplary embodiment includes two toner cartridges 81 storing toner therein, and a toner dispenser 82 that receives the toner from the toner cartridges 81 and supplies the toner to the developing device 14 (see FIG. 1). The two toner cartridges 81 have the same structure. The toner cartridges 81 are an example of a toner storage part.

The developer supply device 70 also includes a carrier cartridge 91 storing carrier therein, and a carrier dispenser 92 that receives the carrier from the carrier cartridge 91 and supplies the carrier to the developing device 14. In this example, the developer supply device 70 has one carrier cartridge 91. The carrier cartridge 91 is an example of a carrier storage part.

The toner cartridges 81 have a cylindrical shape with the central axis extending in the front-rear direction of the developer supply device 70. The toner cartridges 81 can be attached to/removed from the body of the developer supply device 70 in the front-rear direction of the developer supply device 70. More specifically, the toner cartridges 81 are removed from the developer supply device 70 by being pulling toward the front side of the developer supply device 70, and are attached to the developer supply device 70 by being pushed into the developer supply device 70 toward the rear side.

The toner cartridges 81 each have, inside thereof, a toner stirring member 811 for stirring the toner. The toner stirring member 811 is rotationally driven by a driving motor (not shown) to transport the toner inside the toner cartridge 81 from the front side to the rear side while stirring. The toner transport direction in the toner cartridges 81 equals to the direction in which the toner cartridges 81 are attached to/removed from the developer supply device 70 (attachment/removal direction). In this exemplary embodiment, what is meant by "the toner transport direction equals to the attachment/removal direction" is not necessarily be "the toner transport direction is parallel to the attachment/removal direction", but may be "the transport direction has at least a component in the attachment/removal direction".

The toner cartridges 81 have, in the circumferential surfaces thereof, toner discharge portions 813 through which the toner transported by the toner stirring members 811 is discharged into toner reserve tanks 83 (described below) of the toner dispenser 82. In this example, the toner discharge portions 813 are provided on the rear side of the toner cartridges 81, in the lower circumferential portions facing the toner reserve tanks 83. The toner is discharged downward toward the toner reserve tanks 83 through the toner discharge portions 813.

The toner dispenser 82 includes two toner reserve tanks 83 storing the toner received from the corresponding toner cartridges 81, a toner transport part 84 that receives the toner from the toner reserve tanks 83 and transports the toner to the developing device 14, and a toner loading part 85 via which the toner transported through the toner transport part 84 is supplied to the developing device 14. The two toner reserve tanks 83 have the same structure. The toner reserve tanks 83 are an example of a toner supply part.

The toner reserve tanks 83 have a long box shape extending in the front-rear direction of the developer supply device 70. The toner reserve tanks 83 are located vertically below the toner cartridges 81.

The toner reserve tanks 83 have, inside thereof, toner transport members 831 that transport the toner while stirring. The toner transport members 831 are rotationally driven by driving motors (not shown) to transport the toner inside the toner reserve tanks 83 from the rear side to the front side while stirring. In this exemplary embodiment, the toner transport direction in the toner reserve tanks 83 is opposite to the toner transport direction in the toner cartridges 81. The toner transport direction in the toner reserve tanks 83 equals to the attachment/removal direction in which the toner cartridges 81 are attached to/removed from the developer supply device 70.

The toner transport members 831 are, for example, screw augers including rotary shafts extending in the front-rear direction of the toner reserve tanks 83 and spiral blades formed around the rotary shafts.

Furthermore, toner detecting parts 834 are provided in the toner reserve tanks 83. The toner detecting parts 834 detect whether there is toner in the toner reserve tanks 83. The toner detecting parts 834 are provided at positions closer to toner receiving parts 832 than to toner discharge portions 833. The toner detecting parts 834 may be any known sensors, such as magnetic sensors, piezoelectric sensors, photoelectronic sensors, or the like.

The toner reserve tanks 83 have, in the circumferential surfaces thereof, the toner receiving parts 832, from which the toner discharged from the toner discharge portions 813 in the toner cartridges 81 is received, and the toner discharge portions 833, from which the toner transported by the toner transport members 831 is discharged to a toner combining part 841 (described below) of the toner transport part 84.

In this example, the toner receiving parts 832 are provided so as to face the toner discharge portions 813 in the toner cartridges 81. More specifically, the toner receiving parts 832 are provided on the rear side of the toner reserve tanks 83, in the upper circumferential portions facing the toner discharge portions 813 in the toner cartridges 81.

The toner discharge portions 833 are provided on the front side of the toner reserve tanks 83, in the lower circumferential portions facing the toner combining part 841 of the toner transport part 84. The toner is discharged downward toward the toner combining part 841 through the toner discharge portions 833.

The toner transport part 84 includes: the toner combining part 841 where the toner discharged from the toner discharge portions 833 in the toner reserve tanks 83 is combined; and a toner transport path 842 through which the toner having passed through the toner combining part 841 is transported to the toner loading part 85.

The toner transport path 842 has a cylindrical shape extending in the front-rear direction of the developer supply device 70. The toner transport path 842 has, inside thereof, a toner transport member 843 that transports the toner while stirring. The toner transport member 843 is rotationally driven by a driving motor (not shown) to transport the toner inside the toner transport path 842 from the front side to the rear side while stirring. More specifically, the toner transport direction in the toner transport part 84 equals to the attachment/removal direction in which the toner cartridges 81 are attached to/removed from the developer supply device 70.

The toner transported through the toner transport path 842 is supplied to the developing device 14 (see FIG. 1) via the toner loading part 85. In this exemplary embodiment, the toner loading part 85 is located vertically above the developing device 14. At the toner loading part 85, the toner is allowed to fall downward by the gravity and is supplied to the developing device 14.

The carrier cartridge 91 has a cylindrical shape with the central axis extending in the front-rear direction of the developer supply device 70. The carrier cartridge 91 can be attached to/removed from the body of the developer supply device 70 in the front-rear direction of the developer supply device 70. More specifically, the carrier cartridge 91 is removed from the developer supply device 70 by being pulled toward the front side of the developer supply device 70, and is attached to the developer supply device 70 by being pushed into the developer supply device 70 toward the rear side.

Although a detailed description will be given below, the length of the carrier cartridge 91 according to this exemplary embodiment in the attachment/removal direction with respect to the developer supply device 70 (in this example, the length in the front-rear direction) is smaller than the length of the toner cartridges 81 in the attachment/removal direction with respect to the developer supply device 70. The rear end of the carrier cartridge 91 is located closer to the front side of the developer supply device 70 than the rear ends of the toner cartridges 81 are.

The carrier cartridge 91 has, inside thereof, a carrier stirring member 911 for stirring the carrier. The carrier stirring member 911 is rotationally driven by a driving motor (not shown) to transport the carrier inside the carrier cartridge 91 from the front side to the rear side while stirring. More specifically, the carrier transport direction in the carrier cartridge 91 equals to the attachment/removal direction of the carrier cartridge 91 with respect to the developer supply device 70.

The carrier cartridge 91 has, in the circumferential surface thereof, a carrier discharge portion 913 through which the carrier transported by the carrier stirring member 911 is discharged into a carrier reserve tank 93 of the carrier dispenser 92. In this example, the carrier discharge portion 913 is provided on the rear side of the carrier cartridge 91, in the lower circumferential portion facing the carrier reserve tank 93. The carrier is discharged downward toward the carrier reserve tank 93 through the carrier discharge portion 913.

The carrier dispenser 92 includes: the carrier reserve tank 93, serving as a carrier supply part, that stores the carrier received from the carrier cartridge 91; and a carrier loading part 95 via which the carrier stored in the carrier reserve tank 93 is supplied to the developing device 14.

The carrier reserve tank 93 has a long cylindrical shape extending in the front-rear direction of the developer supply device 70. The carrier reserve tank 93 is located vertically below the carrier cartridge 91.

Although a detailed description will be given below, the capacity of the carrier reserve tank 93 according to this exemplary embodiment is smaller than the capacity of a toner reserve tank 83. The sectional area of the carrier reserve tank 93 in a direction perpendicular to the attachment/removal direction of the carrier cartridge 91 with respect to the developer supply device 70 (front-rear direction) is smaller than that of the toner reserve tank 83. In this exemplary embodiment, by making the sectional area of the carrier reserve tank 93 smaller than the sectional area of the toner reserve tank 83, the space for the carrier reserve tank 93 in the developer supply device 70 is reduced.

The carrier reserve tank 93 has, inside thereof, a carrier transport member 931 that transports the carrier while stirring. The carrier transport member 931 is rotationally driven by a driving motor (not shown) to transport the carrier inside the carrier reserve tank 93 from the front side to the rear side of the carrier reserve tank 93 while stirring. In this exemplary embodiment, the carrier transport direction in the carrier reserve tank 93 is equal to the carrier transport direction in the carrier cartridge 91. More specifically, the carrier transport direction in the carrier cartridge 91 equals to the attachment/removal direction of the carrier cartridge 91 with respect to the developer supply device 70.

The carrier transport member 931 is, for example, a screw auger including a rotary shaft extending in the front-rear direction of the carrier reserve tank 93 and a spiral blade formed around the rotary shaft.

Furthermore, a carrier detecting part 934 is provided in the carrier reserve tank 93. The carrier detecting part 934 detects if there is carrier in the carrier reserve tank 93. The carrier detecting part 934 is provided at a position closer to a carrier receiving part 932 than to the carrier loading part 95. The carrier detecting part 934 may be any known sensor, such as a magnetic sensor, a piezoelectric sensor, a photoelectronic sensor, or the like.

The amount of carrier transported by the carrier transport member 931 in the carrier reserve tank 93 is smaller than the amount of toner transported by the toner transport member 831 in the toner reserve tank 83. This is achieved by, for example, making the diameter of the screw auger constituting the carrier transport member 931 smaller than that of the toner transport member 831, or making the blade pitch of the screw auger constituting the carrier transport member 931 smaller than that of the toner transport member 831.

The carrier reserve tank 93 has, in the circumferential surface thereof, the carrier receiving part 932 through which the carrier discharged from the carrier discharge portion 913 in the carrier cartridge 91 is received. The carrier receiving part 932 is provided so as to face the carrier discharge portion 913 in the carrier cartridge 91. More specifically, the carrier receiving part 932 is provided on the front side of the carrier reserve tank 93, in an upper circumferential portion facing the carrier discharge portion 913 in the carrier cartridge 91.

The carrier stored in the carrier reserve tank 93 is supplied to the developing device 14 (see FIG. 1) via the carrier loading part 95. In this exemplary embodiment, the carrier loading part 95 is located vertically above the developing device 14. More specifically, the carrier loading part 95 is located vertically above the toner loading part 85 of the toner dispenser 82. At the carrier loading part 95, the carrier is allowed to fall downward by the gravity and is supplied to the developing device 14. More specifically, at the carrier loading part 95, the carrier is supplied to the developing device 14 by dropping the carrier from vertically above the toner loading part 85.

Operation of Developer Supply Device

Next, the operation of the developer supply device 70 will be described.

The developer supply device 70 supplies the toner and the carrier to the developing device 14 as the toner and the carrier in the developing device 14 decrease. The developing device 14 consumes the toner when forming a toner image on the photoconductor drum 11. In addition, the developing device 14 discharges developer containing carrier whose charging property has decreased. Thus, the toner and the carrier in the developing device 14 decrease.

Typically, the amount by which the carrier in the developing device 14 decreases per unit time is smaller than the amount by which the toner in the developing device 14 decreases per unit time.

For example, when the toner density in the developing device 14 falls below a predetermined reference value, the developer supply device 70 supplies toner to the developing device 14.

More specifically, in the developer supply device 70, the toner stirring members 811 in the toner cartridges 81, the toner transport members 831 in the toner reserve tanks 83, and the toner transport member 843 in the toner transport path 842 are rotationally driven. As a result, in the respective toner cartridges 81, the toner is transported from the front side to the rear side of the toner cartridges 81 by the toner stirring members 811 and flows in the toner reserve tanks 83 of the toner dispenser 82. In the respective toner reserve tanks 83, the toner is transported from the rear side to the front side of the toner reserve tanks 83 by the toner transport members 831 and flows in the toner transport part 84. In the toner transport part 84, the toner is transported from the front side to the rear side in the toner transport path 842 by the toner transport member 843 and flows in the toner loading part 85. Then, the toner falls down from the toner loading part 85 into the developing device 14 and thus is supplied to the developing device 14.

In the developer supply device 70, when the amount of toner stored in a toner cartridge 81 falls below a predetermined reference value (for example, when the toner cartridge 81 become empty), the toner cartridge 81 is removed from the body of the developer supply device 70 to be replaced with a new toner cartridge 81.

In the developer supply device 70 according to this exemplary embodiment, the toner reserve tank 83 of the toner dispenser 82 stores the toner received from the toner cartridge 81. Hence, for example, even when the toner cartridge 81 is removed from the developer supply device 70 for replacement, the supply of toner to the developing device 14 is continued using the toner in the toner reserve tank 83.

As described above, in the developing device 14, the toner decreases by a greater amount than the carrier. Hence, in the developer supply device 70, the amount of toner consumed in the toner cartridges 81 and the toner reserve tanks 83 due to the supply of toner to the developing device 14 is greater than the amount of carrier consumed in the carrier cartridge 91 and the carrier reserve tank 93 due to the supply of carrier to the developing device 14.

The developer supply device 70 according to this exemplary embodiment includes two toner cartridges 81 and two toner reserve tanks 83. Hence, for example, even when one toner cartridge 81 or one toner reserve tank 83 becomes empty, the supply of toner to the developing device 14 is continued using the other toner cartridge 81 and the other toner reserve tank 83.

In addition, as described above, in the developer supply device 70 according to this exemplary embodiment, the toner transport direction in the toner cartridges 81 and the toner transport direction in the toner reserve tanks 83 are opposite to each other. This makes it possible to increase the capacities of the toner cartridges 81 and the toner reserve tanks 83, while avoiding an increase in size of the developer supply device 70, compared with, for example, a case where the toner transport direction in the toner cartridges 81 and the toner transport direction in the toner reserve tanks 83 are equal. As a result, the frequency of replacing the toner cartridges 81 is reduced, and stopping of supply of toner stored in the reserve tanks 83 to the developing device 14 is avoided.

When a toner reserve tank 83 has become empty before the corresponding toner cartridge 81 is replaced with a new one, there is a time lag between when the new toner cartridge 81 is attached and when the toner in the attached toner cartridge 81 is supplied to the developing device 14 via the toner reserve tank 83. To counter this, when the new toner cartridge 81 is attached, a toner transport operation is performed in the toner cartridge 81 and in the toner reserve tank 83 until the toner detecting part 834 detects the toner. Desirably, this toner transport operation is performed before the image forming apparatus 100 receives a print instruction from a user. Because the toner detecting part 834 is provided at a position closer to the toner receiving part 832 than to the toner discharge portion 833, the toner detecting part 834 can accurately detect whether the toner cartridge 81 is empty.

When the amount of carrier in the developing device 14 falls below a predetermined reference value, the developer supply device 70 supplies the carrier to the developing device 14.

More specifically, in the developer supply device 70, the carrier stirring member 911 in the carrier cartridge 91 and the carrier transport member 931 in the carrier reserve tank 93 are rotationally driven. As a result, in the carrier cartridge 91, the carrier is transported from the front side to the rear side of the carrier cartridge 91 by the carrier stirring member 911 and flows into the carrier reserve tank 93 of the carrier dispenser 92. In the carrier reserve tank 93, the carrier is transported from the front side to the rear side of the carrier reserve tank 93 by the carrier transport member 931 and flows into the carrier loading part 95. Then, the carrier falls down from the carrier loading part 95 into the developing device 14 and thus is supplied to the developing device 14.

In the developer supply device 70, when the mount of carrier stored in the carrier cartridge 91 falls below a predetermined reference value (for example, when the carrier cartridge 91 becomes empty), the carrier cartridge 91 is removed from the developer supply device 70 to be replaced with a new carrier cartridge 91.

In this exemplary embodiment, the carrier reserve tank 93 of the carrier dispenser 92 stores the carrier received from the carrier cartridge 91. Hence, for example, even when the carrier cartridge 91 is removed from the developer supply device 70 for replacement, the supply of carrier to the developing device 14 is continued using the carrier stored in the carrier reserve tank 93.

When the carrier reserve tank 93 has become empty before the carrier cartridge 91 is replaced with a new one, there is a time lag between when the new carrier cartridge 91 is attached and when the carrier in the attached carrier cartridge 91 is supplied to the developing device 14 via the carrier reserve tank 93. To counter this, when the new carrier cartridge 91 is attached, a carrier transport operation is performed in the carrier cartridge 91 and in the carrier reserve tank 93 until the carrier detecting part 934 detects the carrier. Desirably, this carrier transport operation is performed before the image forming apparatus 100 receives a print instruction from the user. Because the carrier detecting part 934 is provided at a position closer to the carrier receiving part 932 than to the carrier loading part 95, the carrier detecting part 934 can accurately detect whether the carrier cartridge 91 is empty.

In the developer supply device 70 according to this exemplary embodiment, the capacity of the carrier reserve tank 93 is smaller than the capacity of a toner reserve tank 83.

As described above, in the developer supply device 70, the amount of carrier consumed in the carrier reserve tank 93 due to the supply of carrier to the developing device 14 is smaller than the amount of toner consumed in the toner reserve tank 83 due to the supply of toner to the developing device 14.

Hence, in the developer supply device 70 according to this exemplary embodiment, even though the capacity of the carrier reserve tank 93 is smaller than the capacity of the toner reserve tank 83, a problem such as stopping of supply of the carrier to the developing device 14 is unlikely to occur.

In the developer supply device 70, by making the capacity of the carrier reserve tank 93 smaller than the capacity of the toner reserve tank 83, the overall volume of the carrier dispenser 92 can be reduced. As a result, the developer supply device 70 can be made compact.

In this exemplary embodiment, the length of the carrier reserve tank 93 in the attachment/removal direction of the toner cartridges 81 or the carrier cartridge 91 with respect to the developer supply device 70 is smaller than that of the toner reserve tanks 83. This reduces the distance over which the carrier is transported in the carrier reserve tank 93 and the overall volume of the carrier dispenser 92, compared with, for example, a case where the length of the carrier reserve tank 93 in the attachment/removal direction is equal to or larger than that of the toner reserve tanks 83.

Furthermore, in this exemplary embodiment, the amount of carrier transported by the carrier transport member 931 in the carrier reserve tank 93 is smaller than the amount of toner transported by the toner transport members 831 in the toner reserve tanks 83.

As described above, because the amount by which the carrier is supplied to the developing device 14 is smaller than the amount by which the toner is supplied to the developing device 14, even though the amount of carrier transported by the carrier transport member 931 in the carrier reserve tank 93 is smaller than the amount of toner transported by the toner transport member 831 in the toner reserve tank 83, a problem such as shortage of supply of carrier to the developing device 14 is unlikely to occur. In addition, by making the amount of carrier transported by the carrier transport member 931 in the carrier reserve tank 93 smaller than the amount of toner transported by the toner transport member 831 in the toner reserve tank 83, the carrier reserve tank 93 can easily be made compact.

Furthermore, in the developer supply device 70 according to this exemplary embodiment, as described above, the carrier transport direction in the carrier cartridge 91 and the carrier transport direction in the carrier reserve tank 93 are equal. This reduces the distance over which the carrier is transported in the carrier reserve tank 93, compared with, for example, a case where the carrier transport direction in the carrier cartridge 91 and the carrier transport direction in the carrier reserve tank 93 are opposite to each other.

Furthermore, in the developer supply device 70 according to this exemplary embodiment, the length of the carrier cartridge 91 in the attachment/removal direction with respect to the developer supply device 70 is smaller than the length of the toner cartridges 81 in the attachment/removal direction with respect to the developer supply device 70. The rear end of the carrier cartridge 91 is located closer to the front side of the developer supply device 70 than the rear ends of the toner cartridges 81 are.

Thus, the carrier dispenser 92 can be disposed in, for example, the area resulting from the difference between the length of the carrier cartridge 91 and the length of the toner cartridges 81 (i.e., behind the carrier cartridge 91), and thus, the developer supply device 70 can be made compact.

In general, carrier has a greater specific gravity than toner. Hence, by making the length of the carrier cartridge 91, which stores carrier having a greater specific gravity, in the attachment/removal direction smaller than the length of the toner cartridges 81, which store toner having a smaller specific gravity, in the attachment/removal direction, the distance over which the user moves the carrier cartridge 91 in the attachment/removal direction when attaching/removing the carrier cartridge 91 can be made smaller than the distance over which the user moves the toner cartridges 81 in the attachment/removal direction when attaching/removing the toner cartridges 81.

In the developer supply device 70 according to this exemplary embodiment, the carrier cartridge 91 is located vertically below the toner cartridges 81. More specifically, the part of the carrier cartridge 91 located at the bottom in the vertical direction (hereinbelow, the lowermost part) is located vertically below the lowermost parts of the toner cartridges 81. More desirably, the central axis or the part of the carrier cartridge 91 located at the top in the vertical direction (the uppermost part) is located vertically below the central axes or the uppermost parts of the toner cartridges 81.

Because the carrier cartridge 91, which stores carrier having a greater specific gravity, is located vertically below the toner cartridges 81, which store toner having a smaller specific gravity, the user can attach/remove the carrier cartridge 91 to/from the developer supply device 70 at a position vertically below the position where the toner cartridges 81 are attached/removed.

Furthermore, in the developer supply device 70 according to this exemplary embodiment, the carrier is supplied to the developing device 14 from the carrier loading part 95 by being dropped from vertically above the toner loading part 85.

By supplying the carrier having a greater specific gravity from vertically above the toner having a smaller specific gravity, the toner is pushed by the carrier dropped from vertically thereabove at the toner loading part 85 and is easily guided to the developing device 14. Thus, clogging of toner at the toner loading part 85 is suppressed. In addition, mixing of the toner and the carrier is facilitated, reducing toner density nonuniformity in the developing device 14.

Although the toner is directly supplied from the toner loading part 85 to the developing device 14, and the carrier is directly supplied from the carrier loading part 95 to the developing device 14 in this exemplary embodiment, other structures are also possible.

For example, the toner loading part 85 and the carrier loading part 95 may supply the toner and the carrier to a transport path (not shown) along which the toner and the carrier are transported to the developing device 14, so that the toner and the carrier are supplied to the developing device 14 via the transport path. In this case, for example, it is desirable that the toner is supplied to the transport path from the toner loading part 85, and subsequently, the carrier is supplied to the transport path from the carrier loading part 95, from vertically above the toner being transported.

Although the exemplary embodiment of the present disclosure has been described above, the present disclosure is not limited to the above-described exemplary embodiment as long as the purpose of the present disclosure is not impaired, and may be appropriately modified.

In this exemplary embodiment, the toner cartridges 81 are removed from the developer supply device 70 by being pulled out toward the front side of the developer supply device 70 and are attached to the developer supply device 70 by being pushed into the developer supply device 70 toward the rear side. However, the toner cartridges 81 may be removed from the developer supply device 70 by being pulled out toward the rear side of the developer supply device 70 and may be attached to the developer supply device 70 by being pushed into the developer supply device 70 toward the front side. The carrier cartridge 91 is removed from the developer supply device 70 by being pulled out toward the front side of the developer supply device 70 and is attached to the developer supply device 70 by being pushed into the developer supply device 70 toward the rear side. However, the carrier cartridge 91 may be removed from the developer supply device 70 by being pulled out toward the rear side of the developer supply device 70 and may be attached to the developer supply device 70 by being pushed into the developer supply device 70 toward the front side. In this case, when the image forming units 1Y, 1M, 1C, and 1K and the toner cartridges 81 and the carrier cartridge 91 are attached/removed at the same time, such attachment/removal can be simultaneously performed on the front side and the rear side of the image forming apparatus 100.

In this exemplary embodiment, the toner cartridges 81 have, inside thereof, the toner stirring members 811 for stirring the toner. Instead, the toner may be transported by providing spiral projections on the inner circumferential surfaces of containers constituting the toner cartridges 81 and by rotationally driving the containers with driving motors (not shown). In this exemplary embodiment, the carrier cartridge 91 has, inside thereof, the carrier stirring member 911 for stirring the carrier. Instead, the carrier may be transported by providing a spiral projection on the inner circumferential surface of a container constituting the carrier cartridge 91 and by rotationally driving the container with a driving motor (not shown).

In this exemplary embodiment, the toner detecting parts 834 are provided at positions closer to the toner receiving parts 832 than to the toner discharge portions 833.

Instead, the toner detecting parts 834 may be provided at positions closer to the toner discharge portions 833 than to the toner receiving parts 832. In this case, the toner can be more easily supplied to positions near the toner discharge portions 833 of the toner reserve tanks 83. The carrier detecting part 934 is provided at a position closer to the carrier receiving part 932 than to the carrier loading part 95. Instead, the carrier detecting part 934 may be provided at a position closer to the carrier loading part 95 than to the carrier receiving part 932. In this case, the carrier can be more easily supplied to a position near the carrier loading part 95 of the carrier reserve tank 93.

The foregoing description of the exemplary embodiment of the present disclosure has been provided for the purposes of illustration and description. It is not intended to be exhaustive or to limit the disclosure to the precise forms disclosed. Obviously, many modifications and variations will be apparent to practitioners skilled in the art. The embodiment was chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A developer supply device comprising:

a toner storage part that can be attached to/removed from a body of the developer supply device and stores toner therein;

a toner supply part that receives the toner from the toner storage part and supplies the toner to a developing device that develops an electrostatic latent image formed on an image carrier with developer containing the toner and carrier;

a carrier storage part that can be attached to/removed from the body and stores the carrier therein; and a carrier supply part that receives the carrier from the carrier storage part and supplies the carrier to the developing device, the carrier supply part having a smaller capacity than the toner supply part.

2. The developer supply device according to claim 1, wherein the toner supply part supplies the toner to the developing device after transporting the toner in an attachment/removal direction in which the toner storage part is attached/removed, the carrier supply part supplies the carrier to the developing device after transporting the carrier in the attachment/removal direction, and the length of the carrier supply part in the attachment/removal direction is smaller than the length of the toner supply part in the attachment/removal direction.

3. The developer supply device according to claim 2, wherein the toner supply part transports the toner in a direction opposite to a toner transport direction in the toner storage part.

4. The developer supply device according to claim 2, wherein the carrier supply part transports the carrier in the same direction as a carrier transport direction in the carrier storage part.

5. The developer supply device according to claim 3, wherein the carrier supply part transports the carrier in the same direction as a carrier transport direction in the carrier storage part.

6. The developer supply device according to claim 1, wherein the toner supply part supplies the toner to the developing device after transporting the toner in an attachment/removal direction in which the toner storage part is attached/removed, the carrier supply part supplies the carrier to the developing device after transporting the carrier in the attachment/removal direction, and a sectional area of the carrier supply part in a direction perpendicular to the attachment/removal direction is smaller than a sectional area of the toner supply part in the direction perpendicular to the attachment/removal direction.

7. The developer supply device according to claim 6, wherein an amount of carrier transported by a carrier transport member in the carrier supply part is smaller than an amount of toner transported by a toner transport member in the toner supply part.

8. The developer supply device according to claim 1, wherein the toner supply part supplies the toner to the developing device by dropping the toner, and the carrier supply part supplies the carrier to the developing device by dropping the carrier from vertically above the toner supply part.

9. The developer supply device according to claim 1, wherein a length of the carrier storage part in an attachment/removal direction with respect to the body is smaller than the length of the toner storage part in the attachment/removal direction.

10. The developer supply device according to claim 1, wherein a lowermost part of the carrier storage part in a vertical direction is located vertically below a lowermost part of the toner storage part in the vertical direction.

11. The developer supply device according to claim 10, wherein a central axis or an uppermost part, in the vertical direction, of the carrier storage part is located vertically below a central axis or the uppermost part, in the vertical direction, of the toner storage part.

12. An image forming apparatus comprising:

an image carrier that carries an image;

a developing device that develops an electrostatic latent image formed on the image carrier with developer containing toner and carrier;

a toner storage part that stores the toner and that can be attached to/removed from a body of a developer supply device;

a toner supply part that receives the toner from the toner storage part and supplies the toner to the developing device;

a carrier storage part that can be attached to/removed from the body and stores the carrier therein; and a carrier supply part that receives the carrier from the carrier storage part and supplies the carrier to the developing device, the carrier supply part having a smaller capacity than the toner supply part.

* * * * *